United States Patent [19]

Chietti

[11] 4,236,389

[45] Dec. 2, 1980

[54] CIRCULAR KNITTING MACHINE FOR STOCKINGS OR THE LIKE, HAVING RAISING CAMS WHICH CAN BE MOVED BOTH RADIALLY AND ANGULARLY

[75] Inventor: Giovanni Chietti, Florence, Italy

[73] Assignee: Macchine Tessili Circolari MATEC S.p.A., Italy

[21] Appl. No.: 969,428

[22] Filed: Dec. 14, 1978

[30] Foreign Application Priority Data

Dec. 16, 1977 [IT] Italy ..... 9660 A/77

[51] Int. Cl.[3] ..... D04B 15/68

[52] U.S. Cl. ..... 66/42 R; 66/222

[58] Field of Search ..... 66/38, 40, 216, 222, 66/224, 225, 227, 42

[56] References Cited

U.S. PATENT DOCUMENTS

| | | | |
|---|---|---|---|
| 981,351 | 1/1911 | Ames | 66/40 |
| 1,181,520 | 5/1916 | Glenn | 66/38 |
| 1,933,281 | 10/1933 | Robinson | 66/40 |
| 1,941,091 | 12/1933 | Houseman | 66/40 X |
| 2,161,868 | 6/1939 | Kienel et al. | 66/40 |
| 3,387,466 | 6/1968 | Beckenstein | 66/38 |
| 3,405,542 | 10/1968 | Beckenstein | 66/38 |
| 3,430,463 | 3/1969 | Nebel et al. | 66/42 |
| 3,550,398 | 12/1970 | Widdowson | 66/222 X |
| 3,726,111 | 4/1973 | Negri | 66/225 X |

FOREIGN PATENT DOCUMENTS

| | | | |
|---|---|---|---|
| 2366022 | 9/1977 | Fed. Rep. of Germany | 66/216 |
| 2735307 | 2/1978 | Fed. Rep. of Germany | 66/222 |

*Primary Examiner*—Wm. Carter Reynolds
*Attorney, Agent, or Firm*—McGlew and Tuttle

[57] ABSTRACT

In a circular knitting machine having needle and/or jack butts at different levels, control cams for the butts are selectively movable radially of the needle cylinder, and angularly. Radial movement of the control cams causes the cams to act selectively on all of the butts, on only the upper butts, or on none of the butts, and angular movement of the control cams causes the control cams to effect, selectively, raising of the butts, partial raising of the butts, or raising of none of the butts.

11 Claims, 4 Drawing Figures

CIRCULAR KNITTING MACHINE FOR STOCKINGS OR THE LIKE, HAVING RAISING CAMS WHICH CAN BE MOVED BOTH RADIALLY AND ANGULARLY

FIELD OF THE INVENTION

This invention relates to circular knitting machines, for example for knitting stockings and other articles of hosiery.

SUMMARY OF THE INVENTION

According to the present invention, there is provided in a circular knitting machine, a needle cylinder including needles, means defining control butts arranged at two levels, control cams for the butts, and means for moving the control cams such that the control cams selectively effect complete or partial raising of some or all of the butts or are ineffective to raise any butts.

Further according to the present invention, there is provided in a circular knitting machine a needle cylinder including needles, means defining upper and lower control butts, control cams for the butts, and control means for selectively moving the control cams radially of the needle cylinder, and angularly. The radial movement of the control cams causing the control cams to act selectively on all of the butts, on only the upper butts, or on none of the butts. The angular movement of the control cams causing the control cams to effect, selectively raising of the butts, partial raising of the butts, or raising of none of the butts.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENTS

Figure 1:
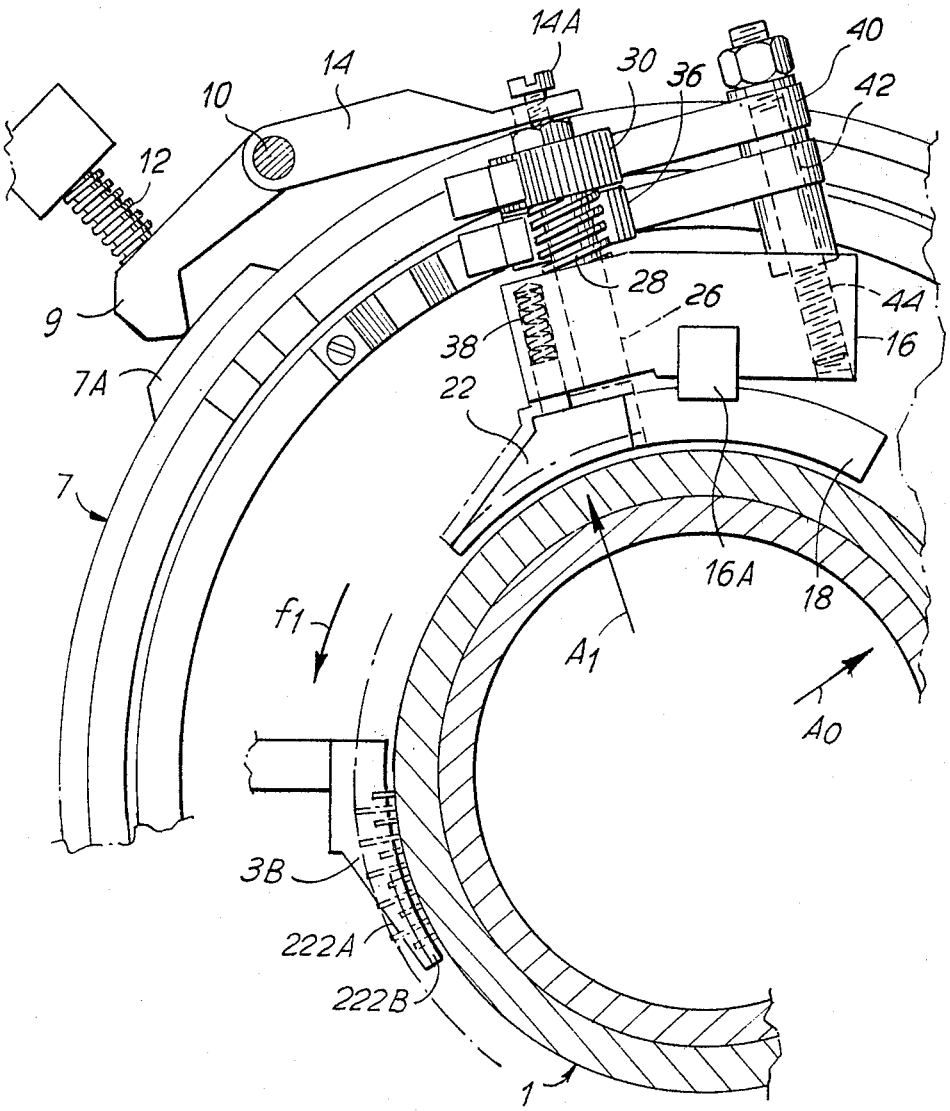
FIG. 1 is a fragmentary plan view in section, of part of a circular knitting machine in accordance with the invention.

In the drawing, 1 denotes a needle cylinder, having needles 3 formed with a pair of butts 3A and 3B at two levels; at each level, the butts 3A and 3B respectively may be of two different radial lengths as shown in detail in FIG. 1. It will be evident that different alignments of the various butts may be provided, to obtain several different needle selections according to the working requirements.

A program drum 7 is positioned co-axially around the needle cylinder and below its upper operative end. The angular advance of the program drum is selectively controlled to provide a predetermined cam program during an operating cycle so as to obtain the desired manufactured article. The drum has tracks for radially-acting cams 7A which co-operate with levers 9 (only one of which is shown in FIG. 1) pivotally mounted on a fixed structure by means of a shaft 10. A spring 12 biases the levers 9 against the cams 7A. Pivotal movements imparted to the levers 9, can be transmitted to different levels in the machine. For example the shaft 10 may carry a control arm 14 which acts in the manner described below, upon a needle raising cam.

In correspondence of a feed shown by arrow A1 there is a block-like support 16 for a pair of vertically-movable cams carried by a slider 16A movable along guide means in the block. The pair of cams comprises a first cam 18 for lowering the needles and acting for example upon the lower butts 3B, and a corresponding countercam 20.

Two so-called angularly-movable "throttle" or control cams 22 and 24 which are pivotal to provide the angular movement are provided downstream of the cams 18 and 20 in the direction of movement of the needle cylinder as shown by the arrow $f_1$, on two levels corresponding to the butts 3A and 3B. The cam 22 is mounted on a shaft 26 carried by the block 16. At its end remote from the needle cylinder, the shaft 26 is subjected to an inwards radial thrust imparted by means of the arm 14 via an adjustable screw-like tappet 14A. The shaft 26 is preferably biased radially outwardly by a spring 28 interposed between the block 16 and a gear 30, mounted on the shaft 26 adjacent to its outer end. The cam 22 can be pivoted by driving the gear 30, and can be moved radially inwardly or outwardly with respect to the cylinder 1 under the action of the arm 14 which is controlled by the lever 9. The cam 24 is mounted on a shaft 32 also carried by the block 16 and is movable radially under the action of a tappet 34A on an arm 34 like the arm 14 and similarly controlled. The shaft 32 also has a gear 36 by which the shaft and the cam 24 can be pivoted. The cam 24 and shaft 32 are biased radially inwardly by a spring 38, and are moved radially outwardly by the arm 34 acting on the head of the tappet 34A.

The two gears 30 and 36 are driven by two sector gear members having sector gears 40 and 42 respectively, pivoted on a shaft 44 about an axis parallel to that of shafts 26 and 32. The sector gears 40 and 42 each have a tappet 40A and 42A respectively, co-operating with annular cams 46 and 48 respectively, which can be accommodated in annular seats provided, for example, in a guide housing 49 fixed to the drum 7, and which can be suitably controlled in two directions. By means of the cams 46 and 48, the sector gears 40 and 42 are controlled to be angularly moved about shaft 44, and these gears cause, through gears 30 and 36, angular movements of the shafts 26 and 32 and of the corresponding cams 22 and 24 to obtain predetermined angular positions of these cams and thereby effect complete or partial predetermined needle raising strokes by acting upon the butts of row 3A and upon the butts of row 3B respectively. The operation of the arms 14 and 34 which are controlled by the radial cams 7A causes the associated cams 22 and 24 to move radially into a selected predetermined radial position where, for example, first each cam can be either excluded from operation when the control cam is in the most radially outward position, second partially included to act only on the radially longer butts when the respective control arm is in an intermediate position, or completely included to act upon all the radially longer and shorter butts of the butt rows 3A and 3B when the respective control arm is in the most radially inward position. Thus, cams 22 and 24 are independently positionable radially and axially of the needle cylinder. By this arrangement, many possibilities for controlling the selective raising of the needles can be obtained together with possibilities of movements which do not require particular devices as required when operating with radial blade cams which involve further operations for connecting and disconnecting.

Figure 2:
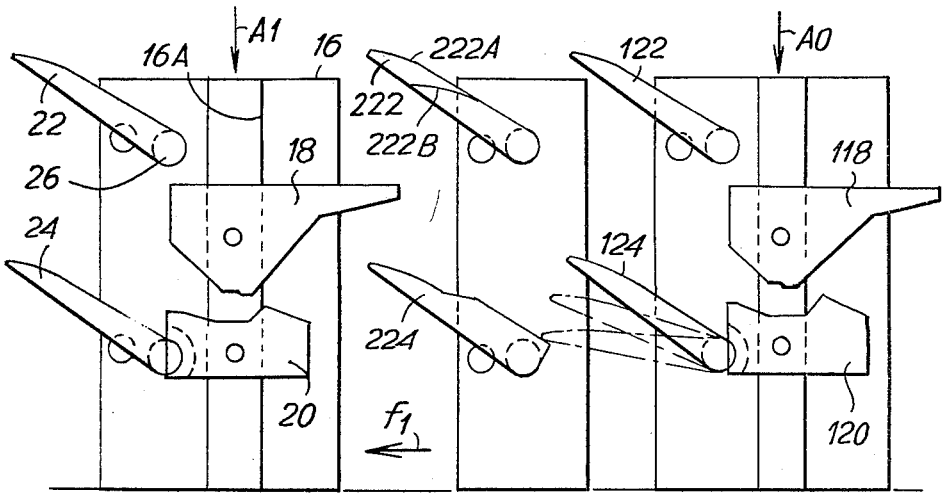
FIG. 2 is a developed view, from the inside, of part of a cam shell of the machine.
Figure 3:
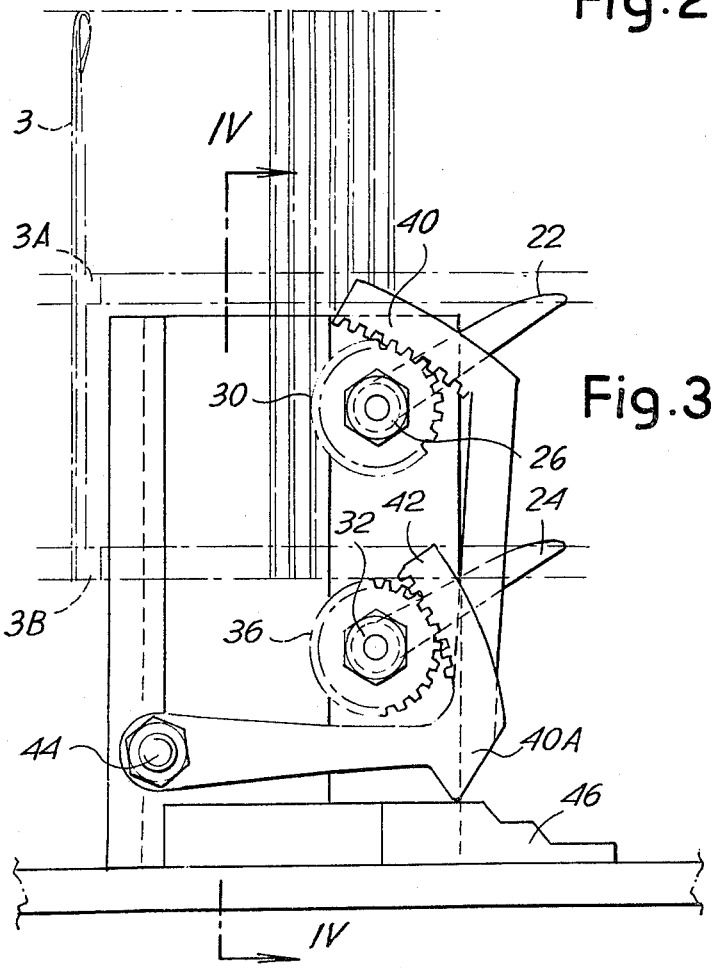
FIG. 3 is an elevation of a part of the cam shell from the outside.
Figure 4:
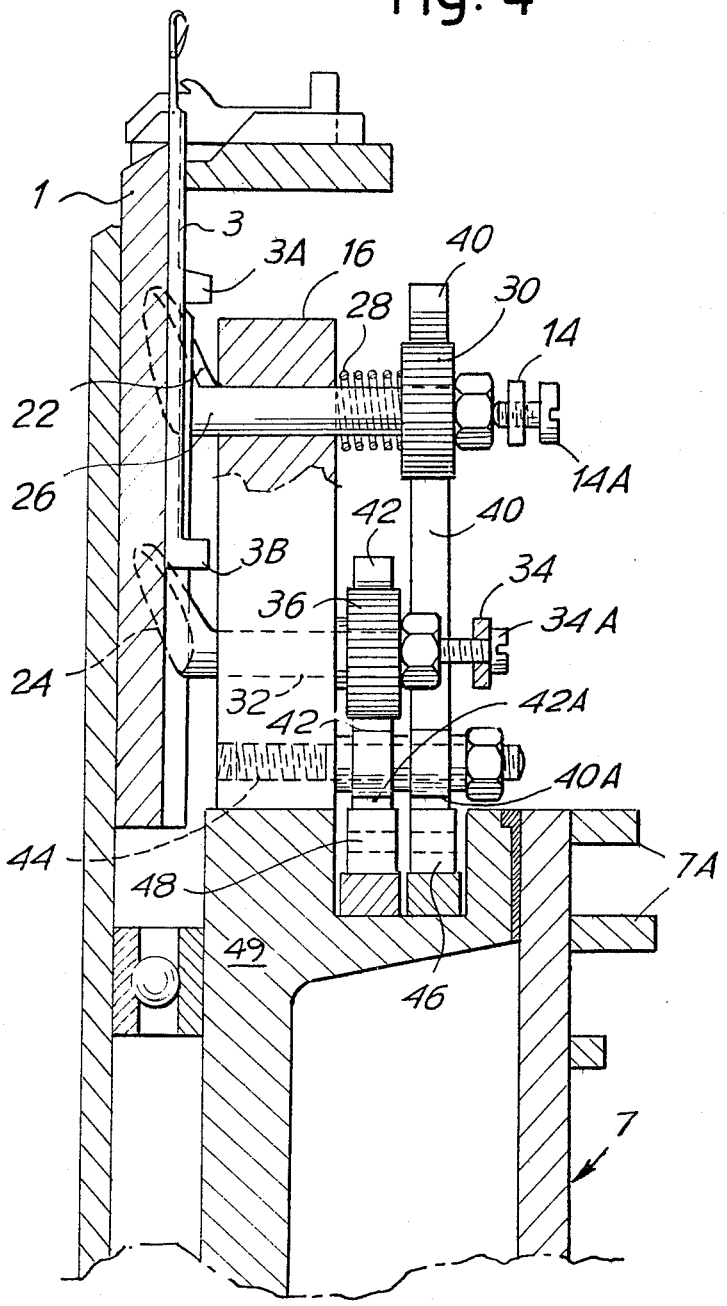
FIG. 4 is a section, taken on line IV—IV of FIG. 3.

The above arrangement has been described with respect to the cams 22 and 24 which are downstream of stitch-forming cams 18 and 20. The arrangement shown in FIG. 2 also has raising cams between the feed A1 and an upstream feed A0 with which a cam 118 and a counter cam 120 are associated, these latter cams corresponding to the cams 18 and 20 respectively, of the feed A1. According to FIG. 2, two pivotal raising cams, denoted by 222 and 224 and substantially corresponding to the cams 22 and 24 are provided between the two sets of cams 118, 120 and 18, 20, in addition to another pair of pivotal raising cams 122 and 124, to obtain a greater selection of the needles which are then to reach the lowering cam 18. In particular cam 222 has, in addition to a profile 222A which extends throughout the upper ridge of the cam, a second profile 222B extending only partially along the cam thickness and forming a step to thereby obtain a different control of the upper and lower butts of the same butt row 3A. This arrangement may be also provided, for specific purposes, on the other pivotal "throttle" cams 22, 24, 122, 124 and 224 to obtain more different needle selections. The number of needle selections may be further increased by the possibility of radial movement of all or some of the cams, together with the pivotal movement in the manner previously described, with reference to the cams 22 and 24.

Although the invention has been particularly described with reference to cams which act directly on butts provided on the needles themselves, the invention is also applicable to cams which act on jack butts and/or needle butts.

The machine is described hereinbefore has a particularly simple cam shell having regard to the large number of different selections which can be obtained. The selection can be changed even during operation of the machine.

What is claimed is:

1. An apparatus for selectively raising needles in a needle cylinder of a circular knitting machine comprising a control butt associated with each of the needles at least at one level thereof for raising each of the needles, a rotatable member arranged concentrically about at least a part of said needle cylinder, a raising cam member for engaging said butts of selected needles being independently positionable radially and axially of said needle cylinder for movements between a position in engagement with said butts of selected needles and a position totally out of engagement with said needles, means for rotatably and axially supporting said raising cam member adjacent said needle cylinder and control means operatively connected to said rotatable member and being engageable with said raising cam member for rotatably and axially moving said raising cam member in response to the rotation of said rotatable member.

2. The apparatus according to claim 1, wherein said raising cam member includes a shaft, a raising cam connected to one end of said shaft and a gear member connected to another end of said shaft, said shaft being movably disposed within said support means, and spring means operatively connected to said support means and biasing said gear member.

3. The apparatus according to claim 2, wherein said control means includes a sector gear member pivotably connected to said support means, a sector gear attached to said sector gear member being operatively connected to said gear member, and an annular cam mounted on said rotatable member being operative to engage said sector gear member.

4. The apparatus according to claim 3, wherein said control means includes a cam lever means for radially moving said raising cam member with respect to said needle cylinder.

5. The apparatus according to claim 2, wherein said raising cam is pivotable about the axis of said shaft.

6. The apparatus according to claim 1, further comprising a control butt extending laterally of each of the needles at a first and at a second level of each of the needles.

7. The apparatus according to claim 6, wherein said control butt at the first level of at least some of the needles has a different length than the control butt at the second level.

8. The apparatus according to claim 7, wherein said raising cam member includes a shaft, a raising cam connected to one end of said shaft and a gear member connected to another end of said shaft, said shaft being movably disposed within said support means, and spring means operatively connected to said support means and biasing said gear member.

9. The apparatus according to claim 8, wherein said control means includes a sector gear member pivotally connected to said support means, a sector gear attached to said sector gear members being operatively connected to said gear member, and an annular cam mounted on said rotatable member being operative to engage said sector gear member.

10. The apparatus according to claim 9, wherein said control means includes a cam lever means mounted on said rotatable member for radially moving said raising cam member with respect to said needle cylinder.

11. The apparatus according to claim 10, wherein said raising cam is pivotable about the axis of said shaft.

* * * * *